US008266816B2

(12) United States Patent
Lim

(10) Patent No.: US 8,266,816 B2
(45) Date of Patent: Sep. 18, 2012

(54) CLOTHES DRYER AND DOOR THEREOF

(75) Inventor: Hyung Sub Lim, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 348 days.

(21) Appl. No.: 12/461,128

(22) Filed: Jul. 31, 2009

(65) Prior Publication Data

US 2010/0088917 A1 Apr. 15, 2010

(30) Foreign Application Priority Data

Oct. 10, 2008 (KR) ..... 20-2008-99607

(51) Int. Cl.
*F26B 3/00* (2006.01)

(52) U.S. Cl. ..... 34/90; 34/601; 34/606; 34/610; 68/92; 68/140

(58) Field of Classification Search ..... 34/78, 80, 34/90, 595, 601, 606, 610, 210; 68/92, 140
See application file for complete search history.

(56) References Cited

U.S. PATENT DOCUMENTS

| | | | | |
|---|---|---|---|---|
| 253,433 | A * | 2/1882 | Shaw | 68/92 |
| 5,113,562 | A * | 5/1992 | Studt | 29/401.1 |
| 5,253,433 | A * | 10/1993 | Frey | 34/603 |
| 7,320,186 | B2 * | 1/2008 | Schöne | 34/603 |
| 7,559,156 | B2 * | 7/2009 | Renzo | 34/595 |
| 7,698,910 | B2 * | 4/2010 | Kim et al. | 68/12.01 |
| 8,127,464 | B2 * | 3/2012 | SchÖNe | 34/603 |
| 2004/0020246 | A1 * | 2/2004 | Yun et al. | 68/24 |
| 2006/0156767 | A1 * | 7/2006 | Kim et al. | 68/175 |
| 2006/0265899 | A1 * | 11/2006 | Renzo | 34/603 |
| 2009/0217547 | A1 * | 9/2009 | Kim et al. | 34/275 |
| 2010/0295428 | A1 * | 11/2010 | Favaro et al. | 312/228 |
| 2011/0214459 | A1 * | 9/2011 | Lim et al. | 68/140 |

FOREIGN PATENT DOCUMENTS

| | | | |
|---|---|---|---|
| DE | 4304086 | C1 * | 3/1994 |
| EP | 1099790 | A2 * | 5/2001 |
| EP | 1609902 | A2 * | 12/2005 |
| JP | 06126100 | A * | 5/1994 |
| KR | 10-2007-0065139 | | 6/2007 |
| WO | WO 03057972 | A1 * | 7/2003 |

* cited by examiner

*Primary Examiner* — Stephen M. Gravini
(74) *Attorney, Agent, or Firm* — Staas & Halsey LLP

(57) ABSTRACT

Disclosed are a clothes dryer and a door thereof. The door includes a glass assembly provided with a door glass; and a door cover connected to the glass assembly. The door cover has a vertically symmetrical structure, and is rotated against the glass assembly and then connected to the glass assembly, when the opening and closing direction of the door is changed. Thereby, when the opening and closing direction of the door is changed, only the door cover is rotated, and thus the opening and closing direction of the door is easily changed.

18 Claims, 4 Drawing Sheets

CLOTHES DRYER AND DOOR THEREOF

CROSS-REFERENCE TO RELATED APPLICATIONS

This application claims the benefit of Korean Patent Application No. 2008-0099607, filed on Oct. 10, 2008, in the Korean Intellectual Property Office, the disclosure of which is incorporated herein by reference.

BACKGROUND

1. Field

The present invention relates to a clothes dryer, and more particularly, to a clothes dryer in which the opening and closing direction of a door can be changed 2. Description of the Related Art In general, a clothes dryer is an apparatus, which forcibly blows hot air to the inside of a drying tub to dry target objects placed in the drying tub. Such a clothes dryer has an external appearance similar to that of a general drum washing machine, and a filter member to filter out foreign substances from the hot air transmitted from the drying tub is installed in the clothes dryer.

For most clothes dryers, the opening and closing direction of a door is determined in advance, i.e., the door is opened in the left or right direction. However, in some cases, the clothes dryer may require a change of the opening and closing direction of the door according to an installation position of the clothes dryer or whether the user is right or left handed.

For example, one clothes dryer and drum washing machine set, in which the sizes and designs of cabinets of the clothes dryer and the drum washing machine are unified, has recently been on sale. When this set is sold, the opening and closing direction of the door of the clothes dryer may be changed to the direction opposite to the opening and closing direction of the door of the drum washing machine. This allows a user to easily move laundry from the drum washing machine to the clothes dryer.

Further, when the opening and closing direction of the door of the clothes dryer is changed, a filter member installed at the rear of the door may be exposed to the outside. Thus, a clothes dryer, which prevents the exposure of the filter member even when the opening and closing direction of a door is changed, is desired.

SUMMARY

Therefore, one aspect of the present exemplary embodiments is to provide a clothes dryer, in which the opening and closing direction of a door is changed as needed by a user.

Another aspect of the present exemplary embodiments is to provide a clothes dryer, which prevents a filter member installed at the rear of the door from being exposed to the outside even when the opening and closing direction of the door is changed.

Additional aspects will be set forth in part in the description which follows and, in part, will be apparent from the description, or may be learned by practice of the embodiments.

The foregoing and/or other aspects may be achieved by providing a clothes dryer, including a cabinet defining an opening; a drying tub rotatably installed in the cabinet; and a door to open and close the opening, the door including a glass assembly provided with a door glass, and a door cover connected to the glass assembly, wherein the door cover is rotated against the glass assembly and then connected to the glass assembly, when an opening and closing direction of the door is changed.

The glass assembly may include a glass cover disposed between the door glass and the door cover and connected to the door cover.

The door cover may include first fixing parts and second fixing parts; the glass cover may include first fixed parts corresponding to the first fixing parts and second fixed parts corresponding to the second fixing parts; and when the door cover is rotated, the first fixing parts may correspond to the second fixed parts and the second fixing parts may correspond to the first fixed parts.

The door cover may have a vertically symmetrical structure.

The door cover and the glass cover may respectively include fixing parts and fixed parts corresponding to each other; and the fixing parts and the fixed parts may be respectively formed in a vertically symmetrical structure.

The glass assembly may further include a glass holder connected to a rear surface of the glass cover to support the door glass; a glass receiving part, on which the door glass is seated, formed on the glass holder; and a contact rib to adhere the door glass to the glass receiving part formed on the rear surface of the glass cover.

The glass holder may include third fixed parts and fourth fixed parts formed at positions corresponding to the respective fixed parts of the glass cover.

Pairs of connection grooves, which are symmetrical with each other, may be respectively formed at sides of the glass holder.

A hinge unit to rotatably open and close the door may be connected to one of the pairs of connection grooves; and a closing member to close the other one of the pairs of connection grooves may be connected to the other one of the pairs of connection grooves.

The hinge unit and the closing member may be selectively connected to the pairs of connection grooves according to the opening and closing direction of the door.

The clothes dryer may further include a filter member filtering out foreign substances from hot air transmitted from the drying tub, and the filter member may be installed in a front region of a lower portion of an inside of the cabinet.

Filter member exposure preventing parts covering the filter member, to prevent the filter member from being exposed to an outside of the clothes dryer, may be respectively formed on the glass holder and the glass cover.

The foregoing and/or other aspects may be achieved by providing a clothes dryer including a cabinet defining an opening; a drying tub rotatably installed in the cabinet; a door opening and closing the opening; the door including a door cover, a glass cover connected to a rear surface of the door cover, a door glass, and a glass holder to support the door glass between the glass holder and the glass cover, wherein the door cover includes first fixing parts and second fixing parts; the glass cover includes first fixed parts at positions corresponding to the first fixing parts and second fixed parts at positions corresponding to the second fixing parts; and when the door cover is rotated to change an opening and closing direction of the door, the first fixing parts correspond to the second fixed parts and the second fixing parts correspond to the first fixed parts.

The foregoing and or other aspects of the present exemplary embodiments are achieved by providing a door of a clothes dryer to open and close an opening formed in a cabinet, including a door cover; a glass cover connected to a rear surface of the door cover; a door glass; and a glass holder to support the door glass between the glass holder and the glass cover, wherein, when an opening and closing direction of the door is changed, the door cover is rotated and then connected to the glass cover.

BRIEF DESCRIPTION OF THE DRAWINGS

These and/or other aspects of the exemplary embodiments will become apparent and more readily appreciated from the following description of the embodiments, taken in conjunction with the accompanying drawings in which.

DETAILED DESCRIPTION OF EMBODIMENTS

Figure 1:
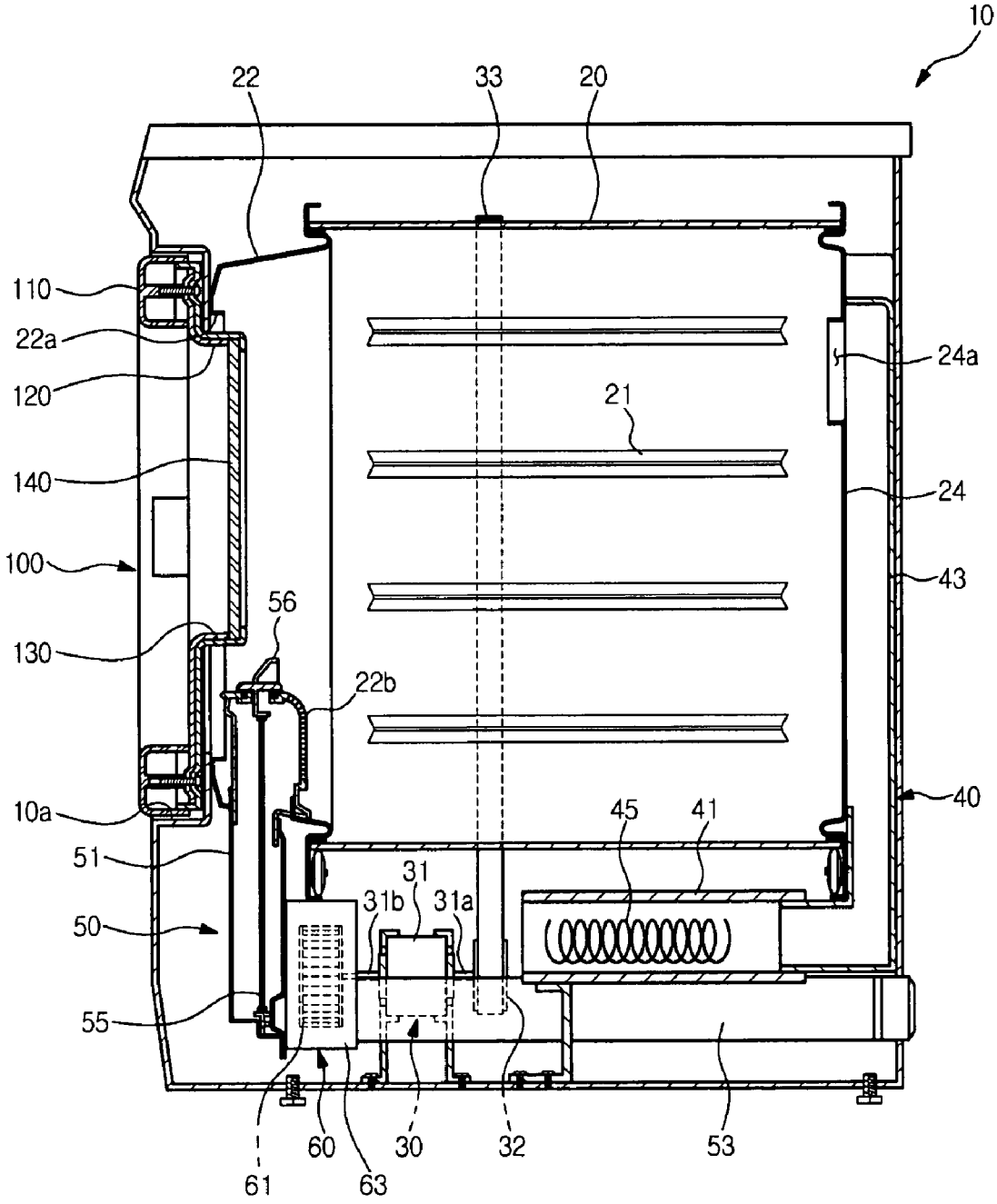
FIG. 1 is a longitudinal-sectional view of a clothes dryer in accordance with an exemplary embodiment.

Reference will now be made in detail to the exemplary embodiment of the present invention, examples of which is illustrated in the accompanying drawings, wherein like reference numerals refer to like elements throughout. The embodiment is described below by referring to the annexed drawings.

As shown in FIG. 1, a clothes dryer in accordance with an exemplary embodiment includes a cabinet 10 forming the external appearance of the clothes dryer, a drying tub 20 rotatably installed in the cabinet 10, a driving device 30 driving the drying tub 20, an intake channel 40, an exhaust channel 50, and a blower device 60 circulating air into the drying tub 20.

The drying tub 20 has a cylindrical shape provided with opened front and rear surfaces, and a plurality of mountain-shaped lifters 21 to lift up and drop objects to be dried protrude from the inner surface of the drying tub 20. A front support plate 22 and a rear support plate 24 are respectively fixed to the inside of the front surface part and the inside of the rear surface part of the cabinet 10. The plates 22 and 24 rotatably support the front and rear opened surface parts of the drying tub 20 and cover the front and rear opened surface parts of the drying tub 20.

Openings 10*a* and 22*a*, through which the objects to be dried are put into or taken out of the inside of the drying tub 20, are respectively formed through the front surface of the cabinet 10 and the front support plate 22, and a door 100 to close and open the openings 10*a* and 22*a* is installed on the front surface of the cabinet 10. The detailed description of the door 100 will be described later.

The driving device 30 includes a driving motor 31 installed in the lower portion of the inside of the cabinet 10, and a pulley 32 and a rotating belt 33 transmitting the driving force of the driving motor 31 to the drying tub 20. The rotating belt 33 is wound on the outer surface of the drying tub 20 and the pulley 32 connected to a shaft 31*a* of the driving motor 31.

The intake channel 40 guides the intake of external air to the inside of the drying tub 20. The intake channel 40 includes a lower intake duct 41 installed below the drying tub 20, and a rear intake duct 43 connecting an intake port 24*a* formed through the upper portion of the rear support plate 24 and the lower intake duct 41. A heater member 45 to heat inhaled air is installed in the lower intake duct 41.

The exhaust channel 50 guides the exhaust of the air inhaled to the inside of the drying tub 20. The exhaust channel 50 includes a front exhaust duct 51 connecting an exhaust port 22*b* formed through the lower portion of the front support plate 22 and an inlet of the blower device 60 installed below the drying tub 20, and a rear exhaust duct 53 installed in the lower portion of the cabinet 10 to connect an outlet of the blower device 60 and the outside of the rear surface of the cabinet 10.

A filter member 55 to filter out foreign substances, such as dust or nap, contained in the hot air exhausted from the drying tub 20 is installed in the front exhaust duct 51. A handle 56 causing a user to easily attach or detach the filter member 55 to or from the front exhaust duct 51 is provided on the upper portion of the filter member 55.

The blower device 60 includes a blower fan 61 installed at a shaft 31*b* being opposite to the shaft 31*a* of the driving motor 31 driving the drying tub 20, and a blower case 63 surrounding the blower fan 61 and respectively connected to the front and rear exhaust ducts 51 and 53.

The above configuration causes the drying tub 20 to be rotated by the operation of the driving motor 31, and causes objects, to be dried, accommodated in the drying tub 20 to be lifted up and dropped down according to the rotation of the drying tub 20 and simultaneously external air to be circulated into the drying tub 20, when the clothes dryer generally performs drying of the objects, thus rapidly drying the objects in the drying tub 20.

The blowing of air is carried out by exhausting damp air in the drying tub 20 to the outside through the exhaust channel 50 and inhaling external air equal to the amount of the exhausted air to the inside of the drying tub 20 through the intake channel 40. The inhaled air through the intake channel 40 is heated by the heater member 45, and then flows to the inside of the drying tub 20, thus rapidly drying the target objects to be dried.

Figure 2:
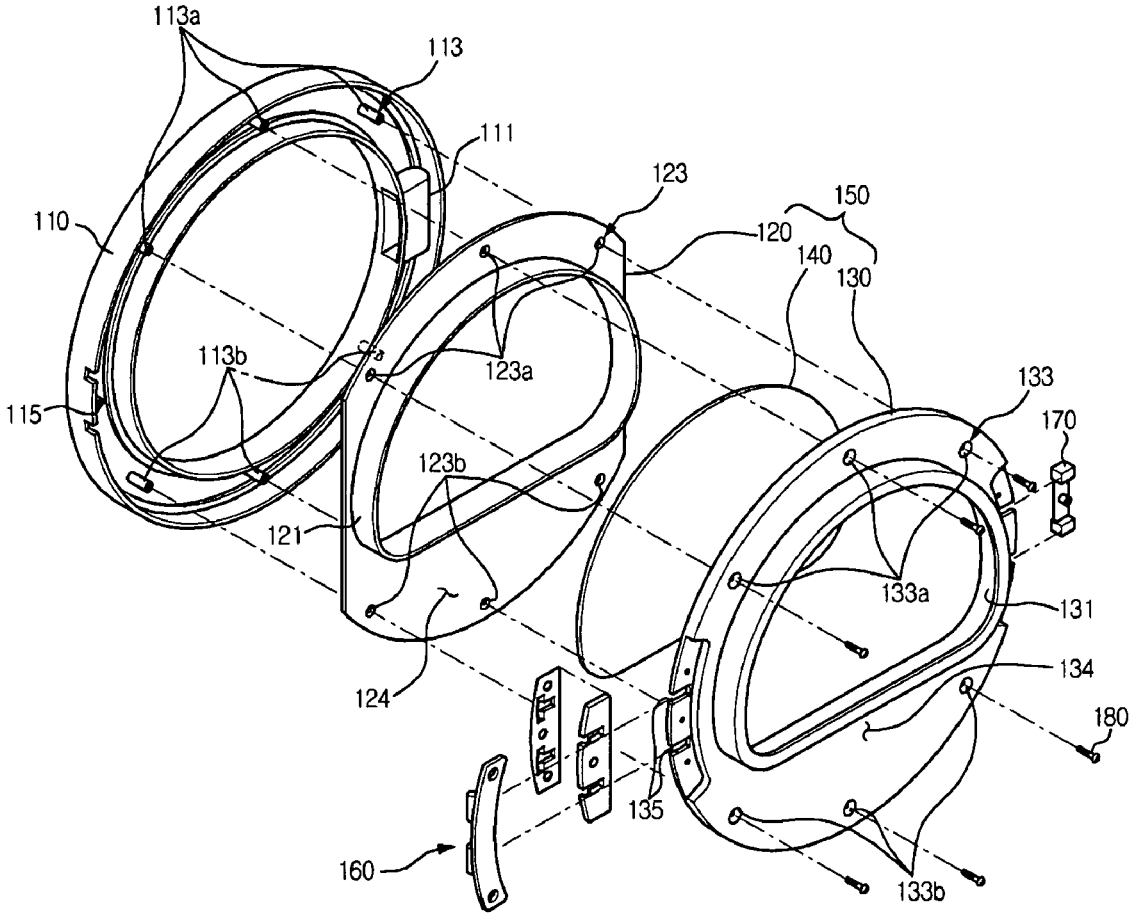
FIG. 2 is an exploded perspective view of a door of the clothes dryer of FIG. 1.
Figure 3:
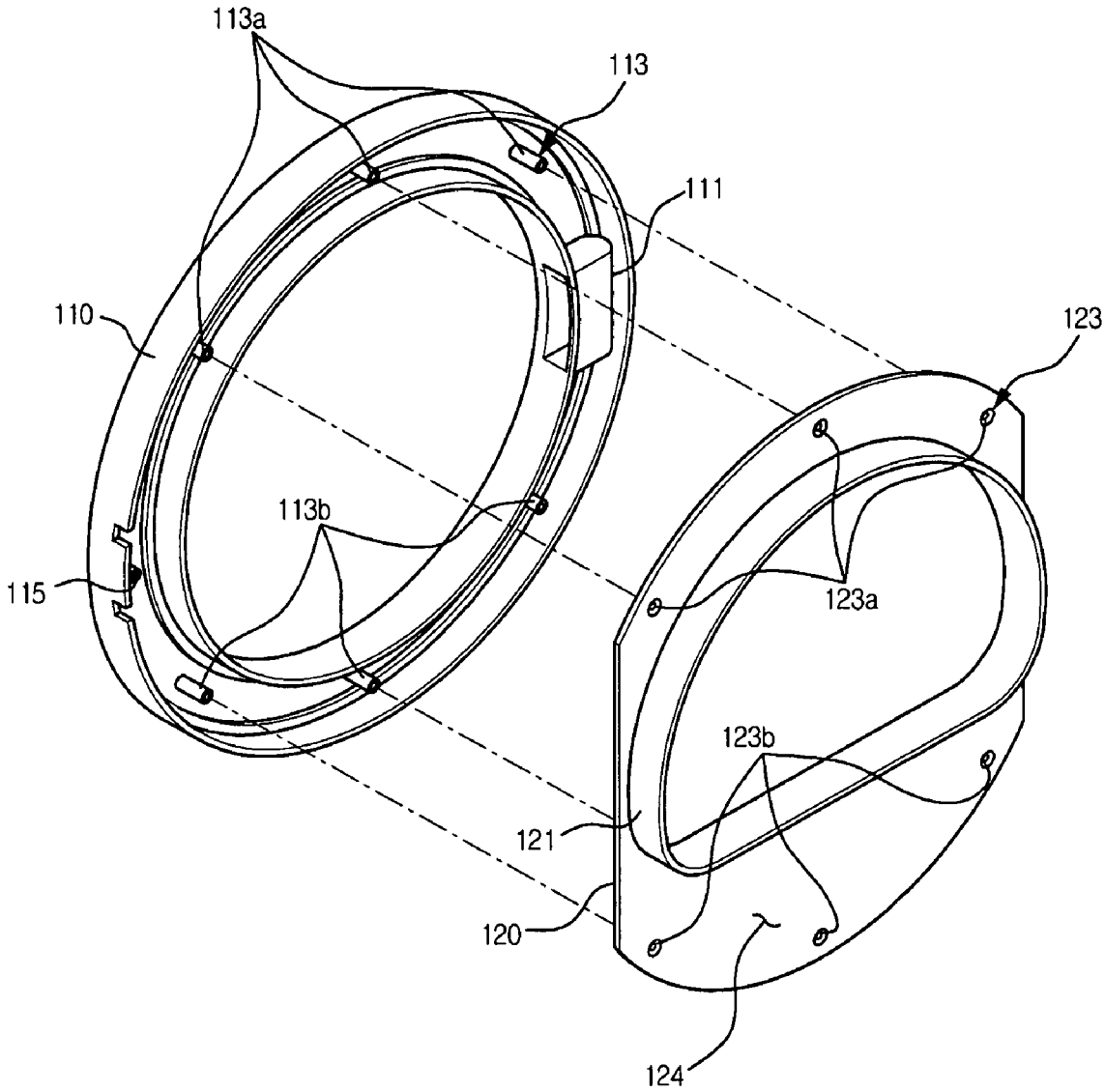
FIG. 3 is a perspective view of a portion of the door of FIG. 2.
Figure 4:
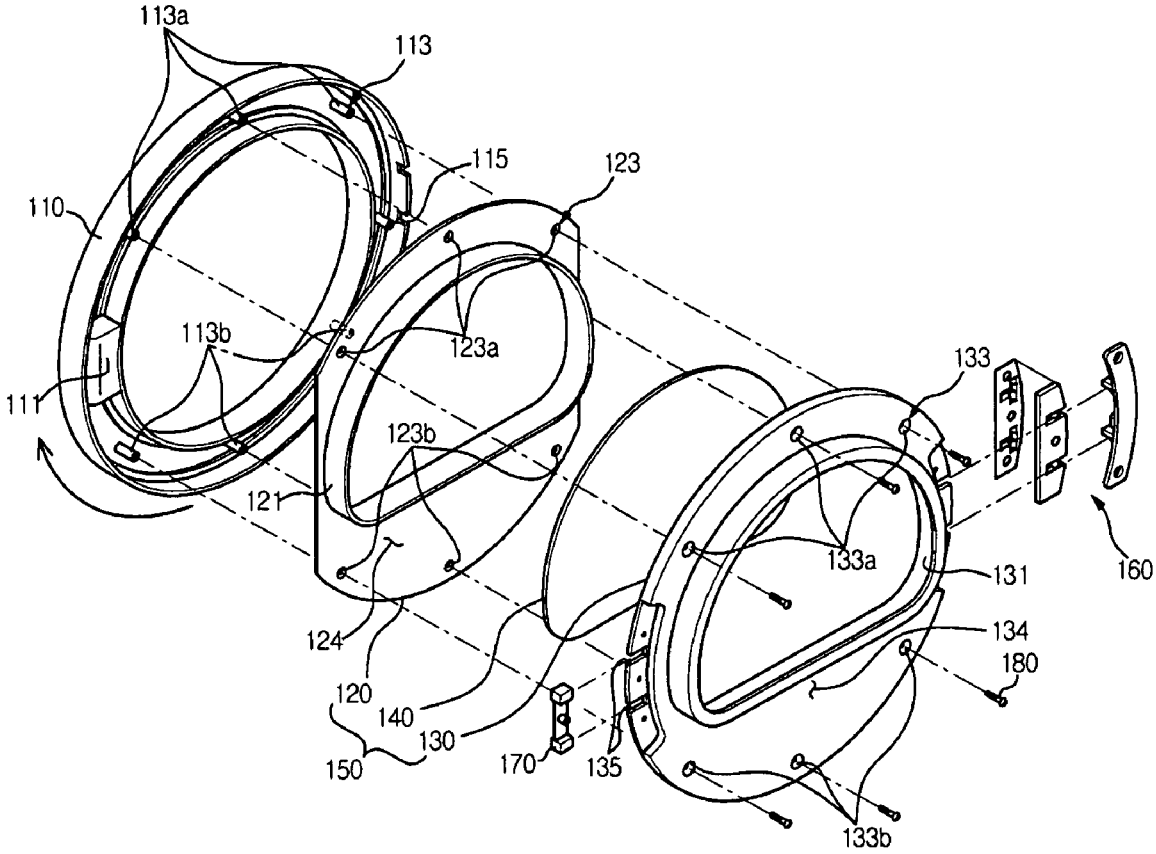
FIG. 4 is an exploded perspective view illustrating a change in an opening and closing direction of the door of the clothes dryer of FIG. 1.

In the clothes dryer in accordance with the exemplary embodiment, the door 100, as shown in FIGS. 2 and 3, includes a door cover 110, and a glass assembly 150 connected to the door cover 110 and supporting a door glass 140.

The door cover 110 forms the front surface of the door 100, and has a vertically symmetrical structure. Fixing parts 113 to connect the door cover 110 to the glass assembly 150 by fixing members 180 are formed on the rear surface of the door cover 110.

The fixing parts 113 protrude backward from the rear surface of the door cover 110, and include first fixing parts 113*a* formed on the upper portion of the rear surface of the door cover 110 and second fixing parts 113*b* formed on the lower portion of the rear surface of the door cover 110. The first and second fixing parts 113*a* and 113*b* are formed in a vertically symmetrical structure (with reference to FIG. 3).

A handle 111 allowing a user to easily open and close the door 100 is formed on the door cover 110, and a hinge unit connecting rib 115 to connect a hinge unit 160, which will be described later, to the door 100 is formed on the door cover 110.

The glass assembly 150 includes a glass holder 130 provided with a glass receiving part 131, on which the door glass 140 is seated, and a glass cover 120 disposed in front of the door glass 140 and provided with a contact rib 121 to closely attach the door glass 140 to the glass receiving part 131 of the glass holder 130.

The glass cover 120 is disposed between the door cover 110 and the door glass 140, and is connected to the door cover 110. Fixed parts 123 to connect the glass cover 120 to the door cover 110 are formed on the glass cover 120 at positions corresponding to the fixing parts 113 of the door cover 110.

The fixed parts 123 include first fixed parts 123*a* and second fixed parts 123*b* formed respectively at positions corresponding to the first fixing parts 113*a* and the second fixing parts 113*b*. The first and second fixed parts 123*a* and 123*b* are formed in a vertically symmetrical structure.

Further, other fixed parts 133, i.e., third fixed parts 133*a* and fourth fixed parts 133*b*, are formed on the glass holder 130 at positions corresponding to the respective fixing parts 113*a* and 113*b* of the door cover 110 and the respective fixed parts 123*a* and 123*b* of the glass cover 120. The third and fourth fixed parts 133*a* and 133*b* are formed in a vertically symmetrical structure, in the same manner as the respective fixing parts 113*a* and 113*b*.

In a process of assembling the door 100, the fixing members 180 are sequentially inserted into the fixed parts 133, the fixed parts 123, and the fixing parts 113 from the rear of the glass holder 130.

Pairs of connection grooves 135, which are bilaterally symmetrical with each other, are respectively formed at left and right sides of the glass holder 130. The hinge unit 160 is connected to the pair of connection grooves 135 formed at one side of the glass holder 130 such that the door 100 is rotatably installed, and a closing member 170 to close the pair of connection grooves 135 is connected to the pair of connection grooves 135 formed at the other side of the glass holder 130. Further, a latch (not shown) to lock the door 100 when the door 100 closes the openings 10*a* and 22*a* may be connected to the other side of the rear surface of the glass holder 130, to which the closing member 170 is connected.

The filter member 55, as shown in FIG. 1, is installed in the front exhaust duct 51, i.e., in the front region of the lower portion of the inside of the cabinet 10. The filter member 55 and a portion of the front exhaust duct 51, in which the filter member 55 is installed, may be exposed to the outside through the door 100.

Therefore, filter member exposure preventing parts 124 and 134 to prevent the filter member 55 from being exposed to the outside through the door 100 are respectively formed on the glass cover 120 and the glass holder 130 of the door 100. The filter member exposure preventing parts 124 and 134 are formed at a position of the glass cover 120 under the contact rib 121 and a position of the glass holder 130 under the glass receiving part 131.

In this embodiment, the opening and closing direction of the door 100 can be changed by the user. In order to change the opening and closing direction of the door 100, after the door 100 is first disassembled, the positions of the hinge unit 160 and the closing member 170 connected to the glass holder 130 are interchanged, and then the hinge unit 160 and the closing member 170 are respectively connected to the corresponding pairs of connection grooves 135. For example, in order to change the opening and closing direction of the door 100 to a left direction, the hinge unit 160 is connected to the pair of connection grooves 135 formed at the left side of the door 100, seen from the front part of the door 100.

Thereafter, the door glass 140 is seated on the glass receiving part 131 of the glass holder 130, and then the door glass 140 seated on the glass receiving part 131 is closely fixed to the glass receiving part 131 using the contact rib 121 formed on the glass cover 120.

Thereafter, only the door cover 110 is rotated at the angle of 180 degrees while the glass cover 120 and the glass holder 130 are left as they are. Then, the fixing members 180 are sequentially inserted into the fixed parts 133*a* and 133*b*, the fixed parts 123*a* and 123*b*, and the fixing parts 113*a* and 113*b* from the rear of the glass holder 130. Thereby, the door 100 is assembled under the condition that the opening and closing direction of the door 100 is changed.

Through the above process, the first fixing parts 113*a* of the door cover 110 correspond to the second fixed parts 123*b* of the glass cover 120, and the second fixing parts 113*b* of the door cover 110 correspond to the first fixed parts 123*a* of the glass cover 120.

Thus, in this embodiment, when the opening and closing direction of the door 100 is changed, the hinge unit 160 and the closing member 170 are connected to interchanged positions of the glass holder 130, and then the door cover 110, the glass cover 120, and the glass holder 130 are connected only by rotating the door cover 110 while the glass cover 120 and the glass holder 130 are left as they are. Thereby, the opening and closing direction of the door 100 can be easily changed.

Further, in this embodiment, when that the opening and closing direction of the door 100 is changed by the user, only the door cover 110 is rotated and the glass cover 120 and the glass holder 130 provided with the filter member exposure preventing parts 124 and 134 are not rotated, and thus it is possible to continuously prevent the exposure of the filter member 55.

As is apparent from the above description, the clothes dryer in accordance with an exemplary embodiment easily changes the opening and closing direction of the door by connecting the hinge unit and the closing member to interchanged positions of the glass holder and connecting the door cover to the glass holder by rotating only the door cover.

Further, the clothes dryer in accordance with the exemplary embodiment prevents the filter member from being exposed to the outside using the filter member exposure preventing parts formed on the glass holder and the glass cover by rotating only the door cover when the opening and closing direction of the door is changed.

Although an exemplary embodiment of the invention has been shown and described, it would be appreciated by those skilled in the art that changes may be made in this embodiment without departing from the principles and spirit of the invention, the scope of which is defined in the claims and their equivalents.

What is claimed is:

1. A clothes dryer, comprising:

a cabinet defining an opening;

a drying tub rotatably installed in the cabinet;

a door to open and close the opening, the door including:

a glass assembly provided with a door glass, and a door cover connected to the glass assembly, wherein the door cover is rotated against the glass assembly and then connected to the glass assembly, when an opening and closing direction of the door is changed.

2. The clothes dryer according to claim 1, wherein the glass assembly includes a glass cover disposed between the door glass and the door cover and connected to the door cover.

3. The clothes dryer according to claim 2, wherein:

the door cover includes first fixing parts and second fixing parts;

the glass cover includes first fixed parts corresponding to the first fixing parts and second fixed parts corresponding to the second fixing parts; and when the door cover is rotated, the first fixing parts correspond to the second fixed parts and the second fixing parts correspond to the first fixed parts.

4. The clothes dryer according to claim 1, wherein the door cover has a vertically symmetrical structure.

5. The clothes dryer according to claim 2, wherein:

the door cover and the glass cover respectively include fixing parts and fixed parts corresponding to each other; and the fixing parts and the fixed parts are respectively formed in a vertically symmetrical structure.

6. The clothes dryer according to claim 5, wherein:

the glass assembly further includes a glass holder connected to a rear surface of the glass cover to support the door glass;

a glass receiving part, on which the door glass is seated, formed on the glass holder; and a contact rib to adhere the door glass to the glass receiving part, formed on the rear surface of the glass cover.

7. The clothes dryer according to claim 6, wherein the glass holder includes third fixed parts and fourth fixed parts formed at positions corresponding to the respective fixed parts of the glass cover.

8. The clothes dryer according to claim 6, wherein pairs of connection grooves, which are symmetrical with each other, are respectively formed at sides of the glass holder.

9. The clothes dryer according to claim 8, further comprising:

a hinge unit to rotatably open and close the door, connected to one of the pairs of connection grooves; and a closing member to close the other one of the pairs of connection grooves, connected to the other one of the pairs of connection grooves.

10. The clothes dryer according to claim 9, wherein the hinge unit and the closing member are selectively connected to the pairs of connection grooves according to the opening and closing direction of the door.

11. The clothes dryer according to claim 6, further comprising a filter member filtering out foreign substances from hot air transmitted from the drying tub, wherein the filter member is installed in a front region of a lower portion of an inside of the cabinet.

12. The clothes dryer according to claim 11, further comprising filter member exposure preventing parts covering the filter member to prevent the filter member from being exposed to an outside of the clothes dryer, respectively formed on the glass holder and the glass cover.

13. A clothes dryer comprising:

a cabinet defining an opening;

a drying tub rotatably installed in the cabinet; and a door to open and close the opening, the door including:

a door cover, a glass cover connected to a rear surface of the door cover, a door glass, and a glass holder to support the door glass between the glass holder and the glass cover, wherein:

the door cover includes first fixing parts and second fixing parts;

the glass cover includes first fixed parts at positions corresponding to the first fixing parts and second fixed parts at positions corresponding to the second fixing parts; and the door cover is rotated against the glass cover and then connected to the glass cover and the first fixing parts correspond to the second fixed parts and the second fixing parts correspond to the first fixed parts, when an opening and closing direction of the door is changed.

14. A door of a clothes dryer to open and close an opening formed in a cabinet, comprising:

a door cover;

a glass cover connected to a rear surface of the door cover;

a door glass; and a glass holder to support the door glass between the glass holder and the glass cover, wherein the door cover is rotated against the glass cover and then connected to the glass cover, when an opening and closing direction of the door is changed.

15. The door according to claim 14, wherein the door cover and the glass cover respectively include fixing parts and fixed parts, which are respectively formed in a vertically symmetrical structure.

16. The door according to claim 15, wherein:

the fixing parts of the door cover include first fixing parts and second fixing parts;

the fixed parts of the glass cover include first fixed parts formed at positions corresponding to the first fixing parts and second fixed parts formed at positions corresponding to the second fixing parts; and when the door cover is rotated, the first fixing parts correspond to the second fixed parts and the second fixing parts correspond to the first fixed parts.

17. The door according to claim 16, wherein the glass holder includes third fixed parts and fourth fixed parts formed at positions corresponding to the respective fixed parts of the glass cover.

18. The door according to claim 17, further comprising:

a glass receiving part, on which the door glass is seated, formed on the glass holder; and a contact rib to adhere the door glass to the glass receiving part, formed on the rear surface of the glass cover.

* * * * *

UNITED STATES PATENT AND TRADEMARK OFFICE

CERTIFICATE OF CORRECTION

PATENT NO. : 8,266,816 B2
APPLICATION NO. : 12/461128
DATED : September 18, 2012
INVENTOR(S) : Hyung Sub Lim It is certified that error appears in the above-identified patent and that said Letters Patent is hereby corrected as shown below:

Title Page, Item (56) (Foreign Application Priority Data); Line 1; Delete "20-2008-99607" and insert -- 10-2008-99607 --, therefor.

Title Page, Item (56) (U.S. Patent Documents); Line 5; Delete "SchÖNe" and insert -- Schöne --, therefor.

Signed and Sealed this
Fourteenth Day of May, 2013

Teresa Stanek Rea
*Acting Director of the United States Patent and Trademark Office*